United States Patent [19]

Cone

[11] Patent Number: 4,521,052

[45] Date of Patent: Jun. 4, 1985

[54] BOOSTER SEAT

[75] Inventor: Richard E. Cone, Dayton, Ohio

[73] Assignee: Spalding & Evenflo Companies, Inc., Tampa, Fla.

[21] Appl. No.: 420,543

[22] Filed: Sep. 20, 1982

[51] Int. Cl.[3] ..... A47D 1/04; A47C 13/00

[52] U.S. Cl. ..... 297/3; 297/1; 297/250; 297/DIG. 2

[58] Field of Search ..... 297/250, 254, 255, 256, 297/DIG. 2, DIG. 1, 464, 183, 118, 1, 2, 3; 5/465, 466; D6/7, 3, 9, 333

[56] References Cited

U.S. PATENT DOCUMENTS

| | | | |
|---|---|---|---|
| D. 230,784 | 3/1974 | Lo Turco | D6/3 |
| 2,418,731 | 4/1947 | Seitz | 297/250 |
| 2,702,076 | 2/1955 | Beardsley et al. | 297/183 |
| 2,792,875 | 5/1957 | Pirrone | 297/183 |
| 3,121,588 | 2/1964 | Beckman et al. | 297/1 |
| 3,285,660 | 11/1966 | Beckman et al. | 297/DIG. 2 |
| 3,555,581 | 1/1971 | Friant | 5/465 |
| 3,556,586 | 1/1971 | Beardmore | 297/3 |
| 3,568,225 | 3/1971 | Radke | 5/465 |
| 3,808,616 | 5/1974 | White | 5/465 |
| 4,190,918 | 3/1980 | Harvell | 5/465 |

FOREIGN PATENT DOCUMENTS

| | | | |
|---|---|---|---|
| 1204320 | 9/1970 | United Kingdom | 297/DIG. 2 |

*Primary Examiner*—William E. Lyddane
*Assistant Examiner*—Mark W. Binder
*Attorney, Agent, or Firm*—John E. Benoit; Donald R. Bahr

[57] ABSTRACT

A child's booster seat having two bases pivotally joined together with each base having seat indentations on opposite sides thereof, the depth of each seat being different from the depth of each of the other seats, whereby the seat provides selectively different heights for the occupant. A strap and buckle may be provided for securing said seat to an adult chair. A waist strap may also be provided for securing the child to the booster seat.

13 Claims, 8 Drawing Figures

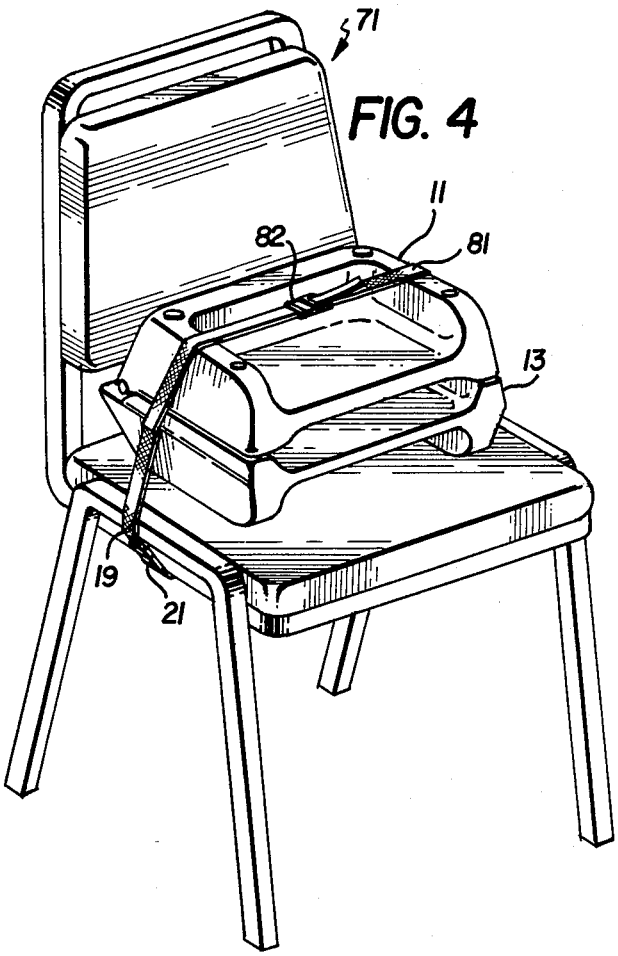
FIG. 4
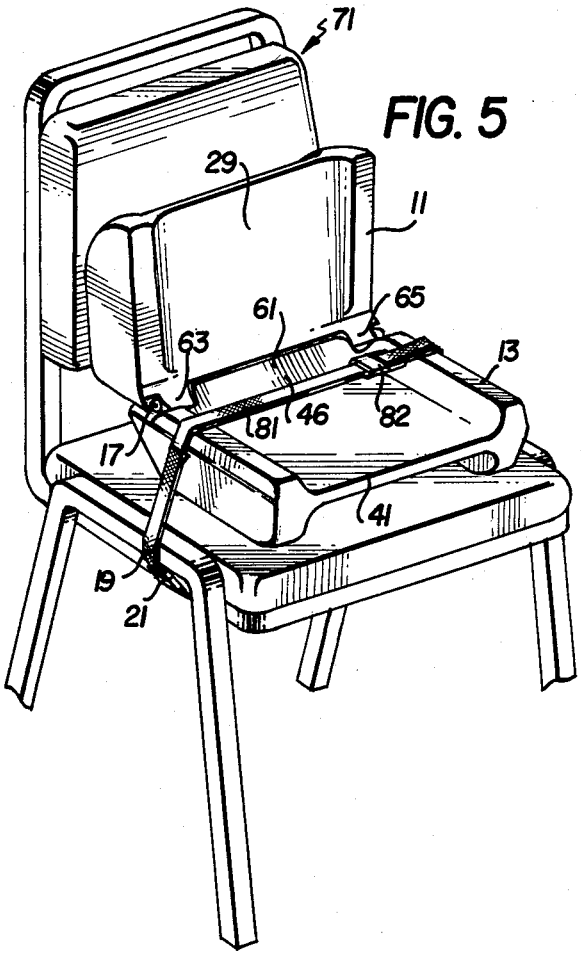
FIG. 5
FIG. 3
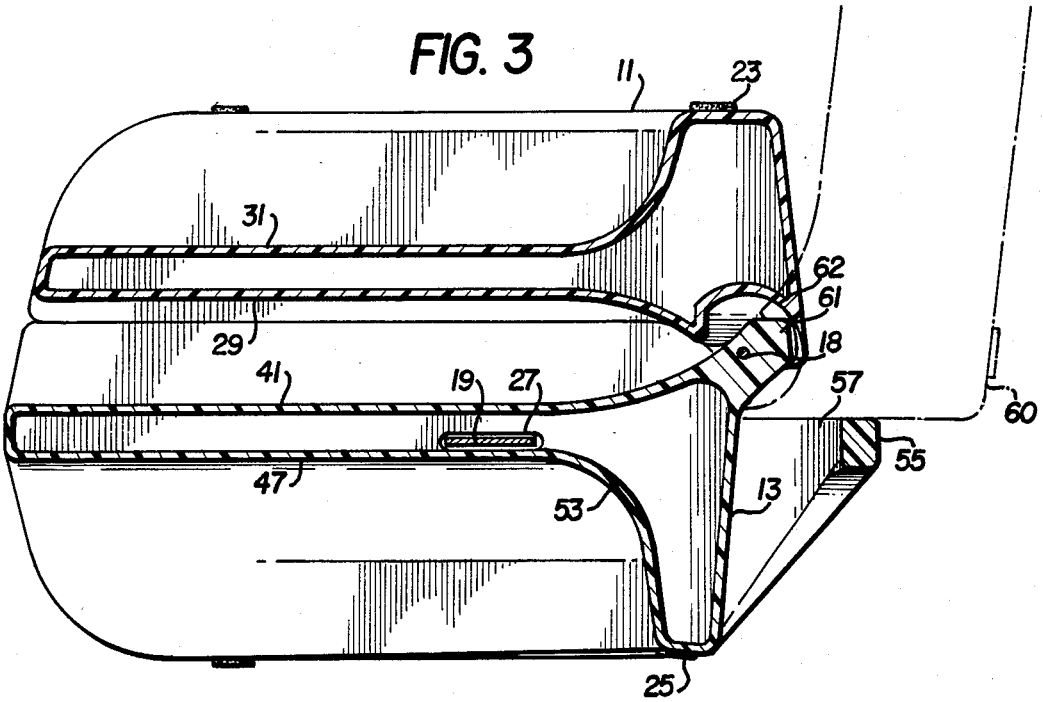

BOOSTER SEAT

This application relates generally to booster seats for children and more specifically to a booster seat for a child which is adjustable to various heights.

Booster seats for children are very well known in the art and are provided primarily so that the child may sit in a standard adult type seat and still be raised above the chair seat so that he may eat from the table.

One of the problems with the booster seat in use at the present time is that it is designed for a child of a certain size, and, as the child grows, he outgrows the booster seat. Conversely, if the seat is made too high, it is not useable for younger children.

Accordingly, it is an object of the present invention to provide a booster seat for a child which is adjustable to selected heights and which also, in some instances, provides a back rest as well as a seat.

A further object of the invention is to provide an adjustable booster seat for a child which is constructed in such a way that it may be carried from place to place.

Another object of this invention is to provide a booster seat for a child which also includes means for securing the seat to a standard adult chair, and/or a waist strap for securing the child to the booster seat.

These and other objects of the invention will become apparent from the following description when taken together with the drawings.

BRIEF DESCRIPTION OF THE DRAWINGS

FIG. 3 is a section view taken along the lines 3—3 of FIG. 1;

FIG. 4 is a view of the booster seat of the present invention secured to a chiar in one of the various selectable positions;

FIG. 5 is a perspective view of the booster seat of the present invent showing a further position of use;

SUMMARY OF THE INVENTION

The invention provides a booster seat having two bases pivotally joined together, each base having a seat indentation on opposite sides thereof. The depth of each seat indentation is different from each of the other seat indentations whereby the seat provides selectively different heights for the occupant. A strap and buckle may be provided for removably securing the seat to an adult chair, and/or a strap and buckle may be provided for securing the child to the booster seat.

DETAILED DESCRIPTION OF A PREFERRED EMBODIMENT OF THE INVENTION

Figure 1:
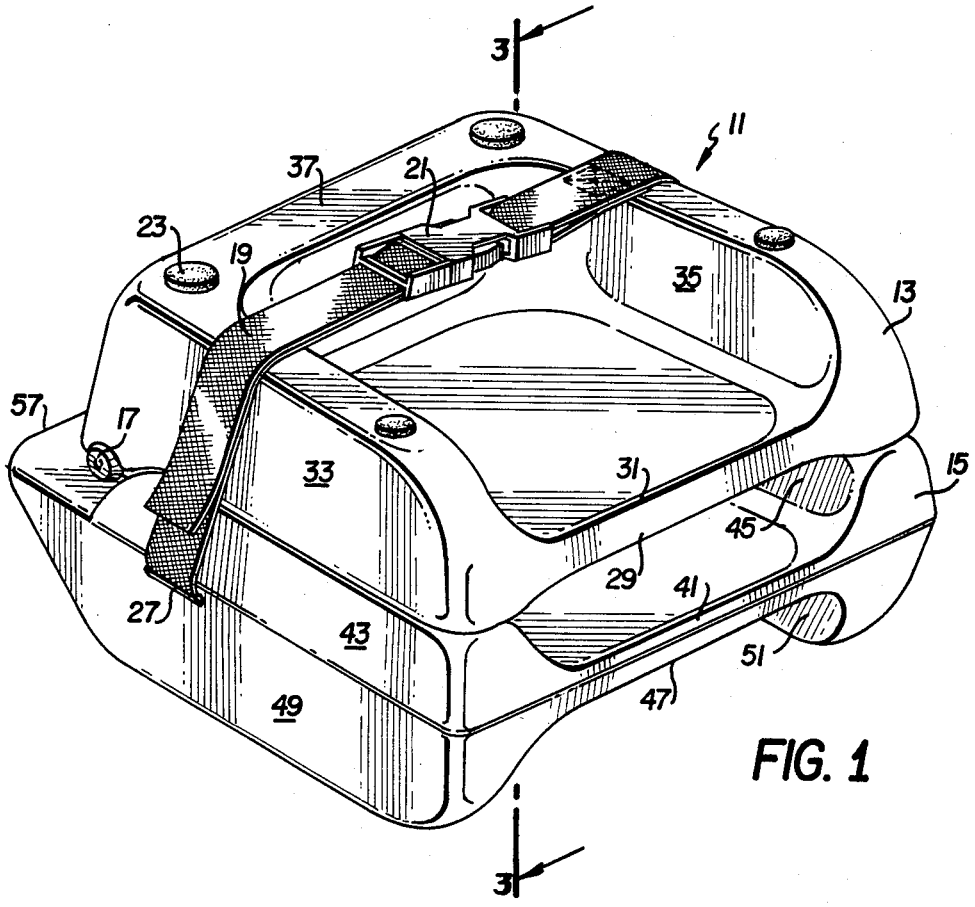
FIG. 1 is a frontal perspective view of the booster seat of the present invention.
Figure 2:
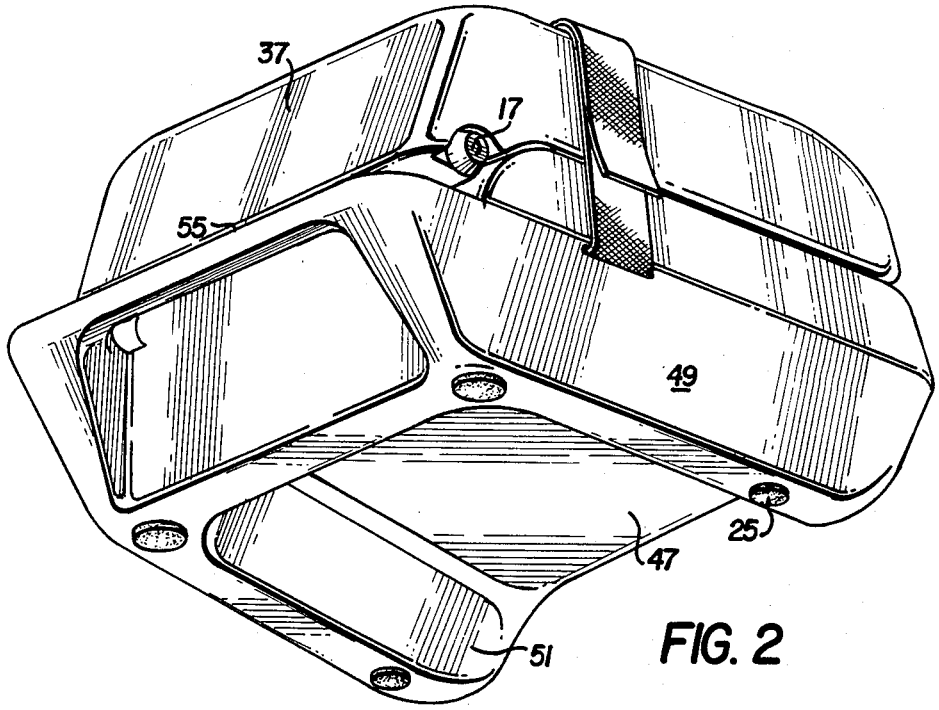
FIG. 2 is a rear perspective view of the booster seat of the invention.

Turning now to the drawings, and particularly to FIGS. 1, 2 and 3, there is shown a booster seat 11 having a first base 13 and a second base 15. These bases are pivotally secured together by a pin 18 (FIG. 3) which is covered by a cap 17. There is also provided strap 19 and buckle 21 which useage will become obvious as the description proceeds. Each section is provided with foot pads 23 and 25 at the four contact points wherein the seats will rest on the chair. Slots 27 extend into second section 15 to accommodate the belt 19.

The first base 13 is preferably a single molded section and provides a first indentation for providing seat 29 on one side thereof and a second indentation for providing seat 31 on the other side thereof. Seat 29 is provided with a slight indentation during the molding process and, thus, is not provided with any substantial side or rear wall sections. Seat 31 has contiguous therewith side wall 33, side wall 35 and rear wall 37.

The second base 15 also is provided with a first seat 41 and a second seat 47. Again, seat 41 has contiguous side walls 43 and 45 and a contiguous rear wall 46 (FIG. 5). The second seat 47 has contiguous side walls 49 and 51 and a contiguous rear wall 53 (FIG. 3).

In order to provide a means for easily transporting the booster seat, a handle 55 is provided as an extension from wall 49 of seat 47. This extension also provides a platform wherein first base 13 may provide, when in use, a back support as will be described below.

Seat 41 has a contiguous projection 61 which extends upwardly to the rear thereof. This projection provides the means through which pin 18 is extended, thereby providing a pivotal point for the relationship between the two bases. In order to accommodate extension 61, base 11 has an arcuate section 62 which is of a dimension which allows first base 11 to rotate about extension 61. The dotted lines 60 indicate the position that first base 11 assumes when it is rotated clockwise and rests upon flange 57 and handle 55. As will be apparent from the following description, one of the bases may be used as a back rest for some of the selected positions of the booster seat.

FIG. 4 shows the booster seat in place on a chair in the same configuration as is shown in FIG. 1. In this position, the belt 19 passes underneath the adult chair 71 and is removably secured together by means of buckle 21. Accordingly, this holds the booster seat in place on chair 71. Also shown is the addition of a second belt 81 and associated buckle 82. Belt 81 passes through slot 27 as does belt 19. Belt 81 may be added so as to provide a waist strap for securing the child to the booster seat.

FIG. 5 shows the booster seat using a different configuration to supply a different height seat. In this configuration, base 11 is rotated in the manner as described relative to FIG. 3 until it rests upon flange 57 and carrying handle 55. It is preferable that the booster seat be adjusted so that section 11 rests against the rear of seat 71. Belt 19 is again adjusted and secured by means of buckle 21.

Figure 6:
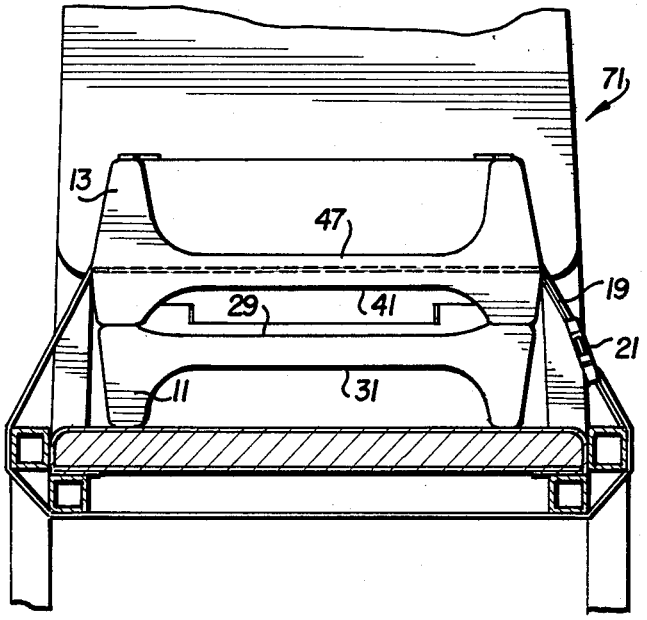
FIG. 6 is a front view of the booster seat of the present invention showing a still further positioning of the seat.

FIG. 6 shows the seat in a position which is inverted from that shown in FIGS. 4 and 5. In this position, first base 11 rests upon the seat of the chair 71 and second base 13 extends thereabove. Again, belt 19 is of a sufficient length so that it may pass underneath the chair and be removably secured at its ends by buckle 21.

Figure 7:
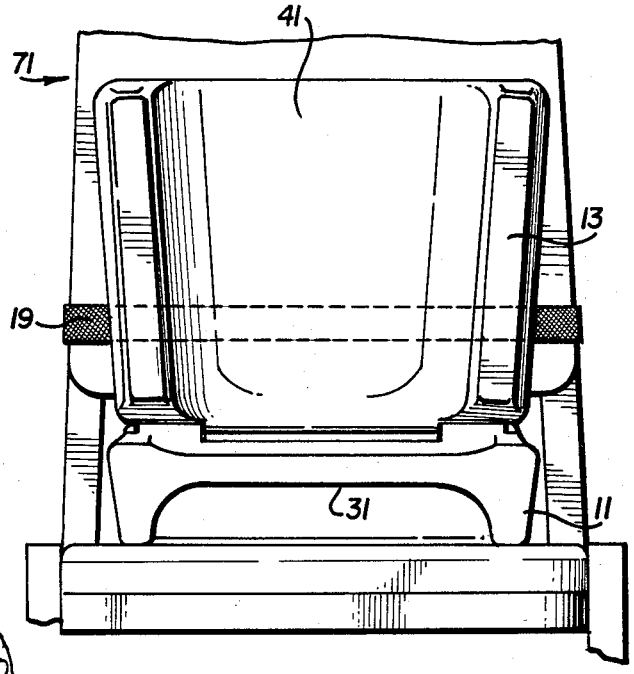
FIG. 7 is a front view of the booster seat of the present invention showing a further position of useage.

FIG. 7 shows a fourth position for the seat wherein first base 11 rests upon the seat of the chair as in FIG. 6, but second base 13 is rotated so as to assume the position as shown in dotted lines in FIG. 3, except that it is in an inverted position. Since base 13 is the base which contains belt 19, in the position shown, belt 19 is passed around the rear of the chair and is secured by the buckle, not shown, behind the chair itself.

As will be evident from the description, the booster seat of the present invention supplies seating positions for a child which provides four different heights and, therefore, may be used for the child as he continues to grow and, yet, still be adequately supportive of the child when the seat is placed on an adult chair.

Figure 8:
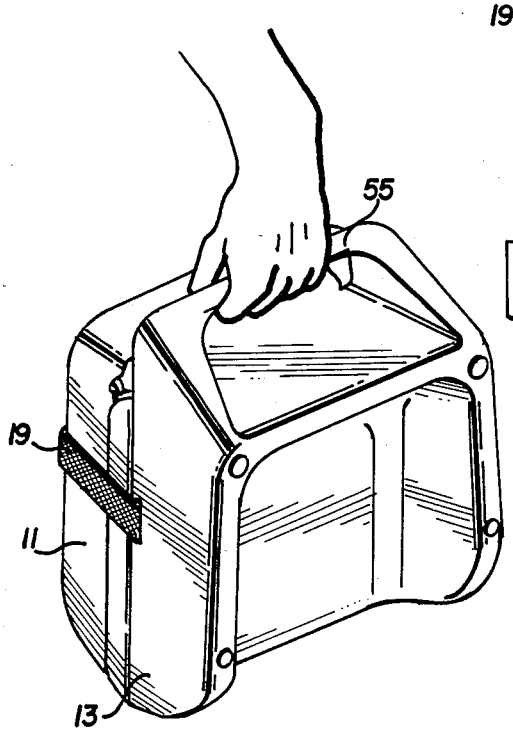
FIG. 8 is a perspective view illustrating the booster seat as it is used in the carrying position.

FIG. 8 shows the seat as it is secured together by belt 19 which is passed from base 13 about base 11 and is secured by a buckle. This provides a very compact and easily portable device. Further, by providing handle 55, it is easily grasped and held as shown in FIG. 8.

It is to be understood that the above description and drawings are illustrative only since components could be varied in specific configuration and heights without departing from the present invention, the scope of which is to be limited only by the following claims.

I claim:

1. A child's booster seat for use with an adult chain comprising a first base having seat indentations on opposite sides thereof;

a second base having seat indentations on opposite sides thereof;

means for pivotally joining said bases at their outer periphery;

the depth of each of said seat indentations being different from the depth of each of the other said seat indentations whereby said booster seat provides four selectively different heights for the child and a back at a selected position.

2. The booster seat of claim 1 further comprising means attached to one of said bases for securing said booster seat to said adult chair.

3. The booster seat of claim 2 wherein said means attached to said one of said bases comprises a flexible belt passing through said one of said bases; and a releasable buckle secured to the free ends of said belt.

4. The booster seat of claim 1 further comprising means attached to one of said bases for securing said child to said booster seat.

5. The booster seat of claim 4 wherein said means attached to said one of said bases comprises a flexible belt passing through one of said bases; and a releasable buckle secured to the free ends of said belt.

6. The booster seat of claim 1 wherein each of said bases comprises a single molded unit.

7. The booster seat of claim 6 further comprising means attached to one of said bases for securing said booster seat to said adult chair.

8. The booster seat of claim 7 wherein said means attached to said one of said bases comprises a flexible belt passing through said one of said bases; and a releasable buckle secured to the free ends of said belt.

9. The booster seat of claim 6 wherein each of said bases comprises a single molded unit.

10. The booster seat of claim 6 further comprising handle means secured to one of said bases.

11. The booster seat of claim 1 further comprising handle means secured to one of said bases.

12. A child's booster seat for use with an adult chair comprising a first section comprising a first base;

an indentation in one side of said base so as to form a first seat;

side walls and a rear wall extending substantially laterally and equally from the other side of said base so as to form a second seat;

a second section comprising a second base;

side walls and a rear wall extending substantially laterally and equally from one side of said second base so as to form a third seat;

side walls and a rear wall extending substantially laterally from the other side of said second base so as to form a fourth seat;

each of said second, third and fourth seats having side walls and rear walls of a different lateral dimension than the side walls and rear walls of said other seats; and hinge means for securing said one side of said first section opposite said rear of said other side to one of said rear walls of said second section.

13. The booster seat of claim 12 further comprising means attached to one of said bases for securing said child to said booster seat.

* * * * *

UNITED STATES PATENT AND TRADEMARK OFFICE

CERTIFICATE OF CORRECTION

PATENT NO. : 4,521,052

DATED : June 4, 1985

INVENTOR(S) : Richard E. Cone

It is certified that error appears in the above-identified patent and that said Letters Patent is hereby corrected as shown below:

Claim 1, line 1; delete "chain" and insert therefor --chair--.

Signed and Sealed this

*First* Day of *October 1985*

[SEAL]

*Attest:*

DONALD J. QUIGG

*Attesting Officer*

*Commissioner of Patents and Trademarks—Designate*